US005433619A

United States Patent [19]

Maejima

[11] Patent Number: 5,433,619

[45] Date of Patent: Jul. 18, 1995

[54] EASY-OPERATION-TYPE CONNECTOR

[75] Inventor: Toshiro Maejima, Shizuoka, Japan

[73] Assignee: Yazaki Corporation, Japan

[21] Appl. No.: 225,640

[22] Filed: Apr. 11, 1994

[30] Foreign Application Priority Data

Apr. 12, 1993 [JP] Japan ..... 5-084335

[51] Int. Cl.[6] ..... H01R 13/62

[52] U.S. Cl. ..... 439/157; 439/347

[58] Field of Search ..... 439/153-157, 439/341-342, 372, 347

[56] References Cited

U.S. PATENT DOCUMENTS 5,238,417 8/1993 Hatagishi ..... 439/153
5,344,194 9/1994 Hatagishi et al. ..... 439/157
5,348,489 9/1994 Yeh ..... 439/153

FOREIGN PATENT DOCUMENTS 1-159978 6/1989 Japan .
3-274684 12/1991 Japan .
4-206371 7/1992 Japan .

*Primary Examiner*—Larry I. Schwartz

*Assistant Examiner*—Jill DeMello

*Attorney, Agent, or Firm*—Wigman, Cohen, Leitner & Myers

[57] ABSTRACT

An easy-operation-type connector includes a male connector, a female connector to be engaged with the male connector, and a driving lever for coupling and detaching the male and female connectors. The male connector includes a male connector main body, a first top face formed on the male connector main body, a driven recess formed in the male connector main body, an inclining face formed as an inner wall of the driven recess, and vertical face formed as an inner wall of the driven recess. The female connector includes a female connector main body, a second top face formed on the female connector main body, a receiving recess formed in the female connector main body, an engaging recess formed in the female connector main body, and an aperture formed in the female connector main body. The driving lever includes a driving lever main body, an engaging projection formed in the driving lever main body, a driving projection formed in the driving lever main body.

5 Claims, 8 Drawing Sheets

EASY-OPERATION-TYPE CONNECTOR

BACKGROUND OF THE INVENTION

1. Technical Field

The present invention relates to an electric connector which is used mainly for electrical wiring in automobiles and includes a pair of housings to be engaged with and removed from each other by other driving means.

2. Background Art

FIGS. 1 to 3 show respectively an easy-operation-type connector which is disclosed in Japanese Patent Application for Disclosure (HEI) 1-159978.

In FIG. 1, reference numeral 1 designates a male connector housing, and reference 2 denotes a female connector housing, both of which include male metal terminals and female metal terminals (not shown), respectively.

As shown in FIGS. 1 and 2, the male connector housing 1 is provided with upper terminal receiving holes 3 and lower terminal receiving holes 4. Also in the male connector housing 1, a through hole 5 extending in the vertical direction to the engaging or detaching direction of terminals is provided between these terminal receiving holes 3, 4. In the through hole 5 a skew wall 6 is provided to divide the internal space of the hole into engaging operation hole 7 and detaching operation hole 8.

In one side wall 10 of cover 9 of the female connector housing 2 a guide hole 11 and a through hole 12 are provided in parallel. The guide hole 11 guides a driving member 13 to the entrance of engaging operation hole 7. The through hole 12 faces the exit of detaching operation hole 8.

Further, another guide hole 15 and another through hole 16 are provided in the other side wall 14 of female connector housing 2. This guide hole 15 guides the driving member 13 to the entrance of detaching operation hole 8. The through hole 16 faces the exit of engaging operation hole 7.

To engage the male connector housing 1 with the female connector housing 2, the male connector housing 1 is inserted into the cover portion 9 of female connector housing 2. In that case, the male connector housing 1 is so inserted lightly in the female connector housing 2 that the entrance portion of engaging operation hole 7 is approximately located at the guide hole 11 and the female and male metal terminals are not yet in contact with each other. Then, the driving member 13 is inserted in the engaging operation hole 7 through the guide hole 11. As a result, the driving member 13 slides on a tapered portion 17 of skew wall 6 with pressing the wall in the direction along which the male connector housing 1 is inserted in the cover portion 9.

To remove the male connector housing 1 from the female connector housing 2, the driving member 13 is inserted in the detaching operation hole 8 through the guide hole 15. Then, the driving member 13 presses the tapered portion 17 in the direction along which the male connector housing 1 is detached from the female connector housing 2.

In such a prior art, however, the position of the driving member must be changed from one guide hole to another on each engaging or detaching operation.

SUMMARY OF THE INVENTION

Therefore, it is an object of the present invention to provide an easy-operation-type connector in which the engagement and detachment between the male and female connector housings can be carried out without changing the position of the driving member.

To achieve the above object, the present invention provides an easy-operation-type connector.

This easy-operation-type connector includes a male connector, a female connector to be engaged with the male connector, and a driving lever for coupling and detaching the male and female connectors. The male connector includes a male connector main body, a first top face formed on the male connector main body, a driven recess formed in the male connector main body and having an opening in the first top face, an inclining face formed as an inner wall of the driven recess. The inclining face gradually descends along the removal direction of the male connector. The male connector further includes a vertical face formed as an inner wall of the driven recess. The vertical face faces in the engaging direction of the male connector. The female connector includes a female connector main body, a second top face formed on the female connector main body, a receiving recess formed in the female connector main body to receive the male connector, an engaging recess formed in the female connector main body and having an opening in the second top face, and an aperture formed in the female connector main body and comunicating from the second top face to the receiving recess. The driving lever includes a driving lever main body, and an engaging projection formed in the driving lever main body. The engaging projection is detachably engaged with the corresponding engaging recess. The driving lever further includes a driving projection formed in the driving lever main body. The driving projection cooperates with the corresponding inclining face to move the male connector in the engaging direction when the driving lever is moved downwardly, and cooperates with the corresponding vertical face to move the male connector in the detaching direction when the driving lever pivots on the engaging projections as the engaging projection is engaged with the engaging recess.

In the above connector according to the present invention, the driving projection of the driving lever is inserted in the corresponding driving recess of the male connector through each communicating hole of the female connector to make the driving projection be in contact with the corresponding inclining face. Then, the driving projection is moved downward sliding on the inclining face. Thus, the male connector is moved to be engaged with the female connector. On the other hand, when the driving lever is pivoted with each engaging projection of the driving lever being engaged with each engaging recess of the female connector, each driving projection slides on the corresponding vertical face to move the male connector in the detaching direction.

Accordingly, by such downward movement and pivot movement of the driving lever, both the coupling operation and detaching operation between the male and female connectors can be carried out. Therefore, this inventive connector can provide more facilitated coupling and detaching operations as well as more compact structure as compared to the aforementioned prior art.

These and other objects, features and advantages of the present invention will be more apparent from the following description of a preferred embodiment, taken in conjunction with the accompanying drawings.

DESCRIPTION OF THE PREFERRED EMBODIMENT

Hereinafter, one embodiment of the present invention will be described with reference to FIGS. 4 to 11.

Figure 1:
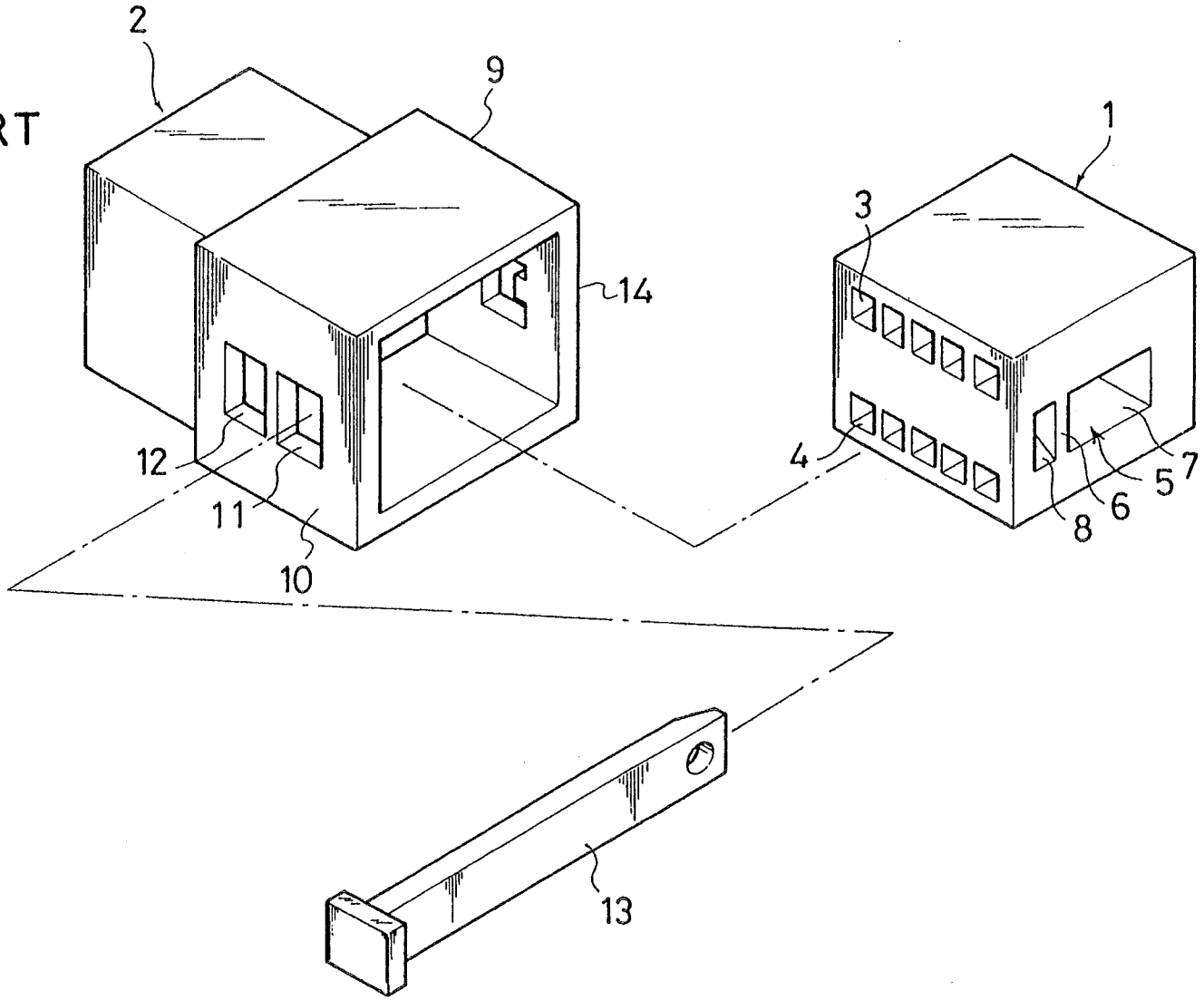
FIG. 1 PRIOR ART
FIG. 1 is a perspective view of a conventional connector in a separated state.
Figure 2:
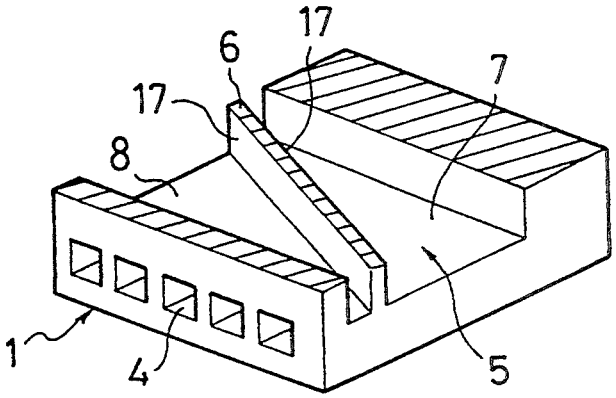
FIG. 2 PRIOR ART
FIG. 2 is a partly broken perspective view of the male connector shown in FIG. 1.
Figure 3:
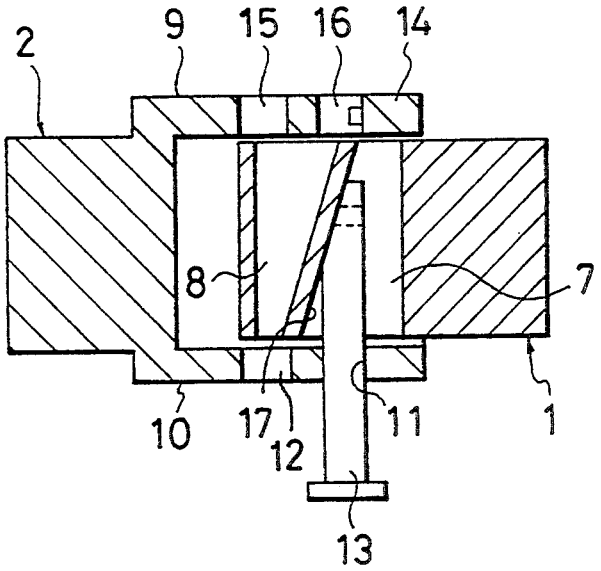
FIG. 3 PRIOR ART
FIG. 3 is a cross-section of the conventional connector of FIG. 1 in which the male and female connectors are engaged halfway.
Figure 4:
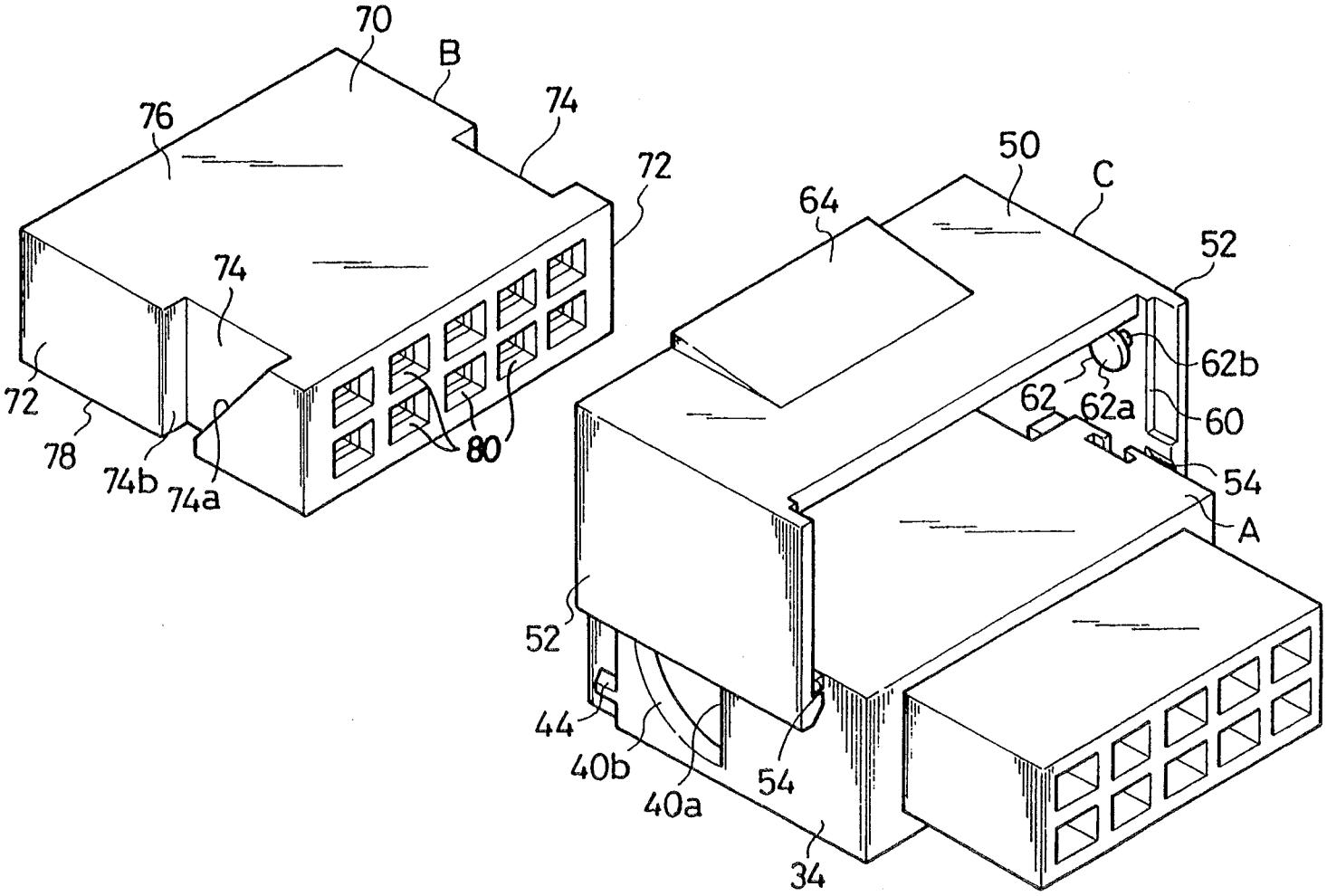
FIG. 4 is a perspective view of one embodiment of the present invention, in which the male and female connectors are separated from each other.

In FIG. 4, reference characters A and B designate a female connector and a male connector, respectively. The female connector A is provided with a driving lever C.

Figure 5:
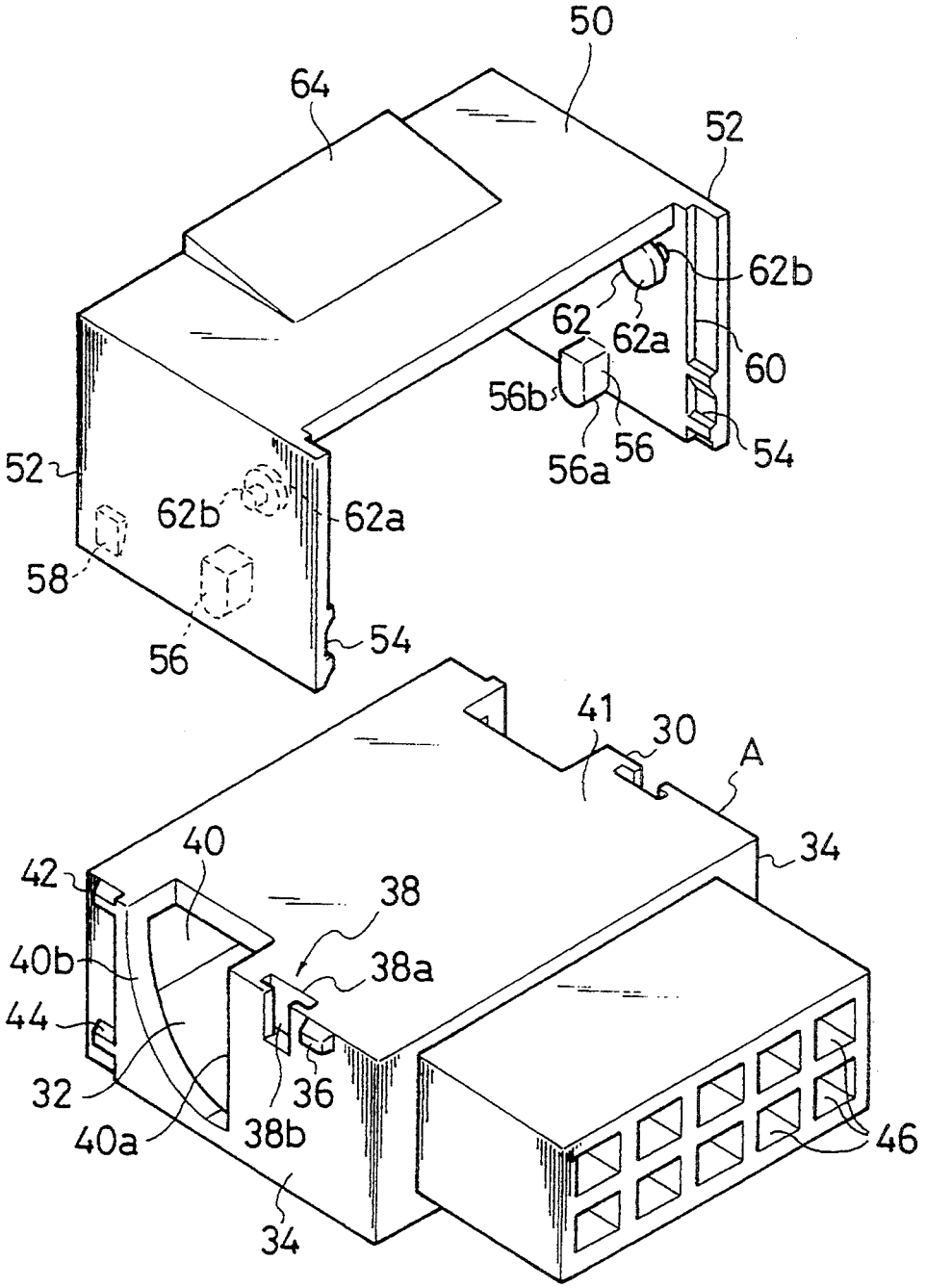
FIG. 5 is a perspective view in which the driving lever is separated from the female connector.
Figure 6:
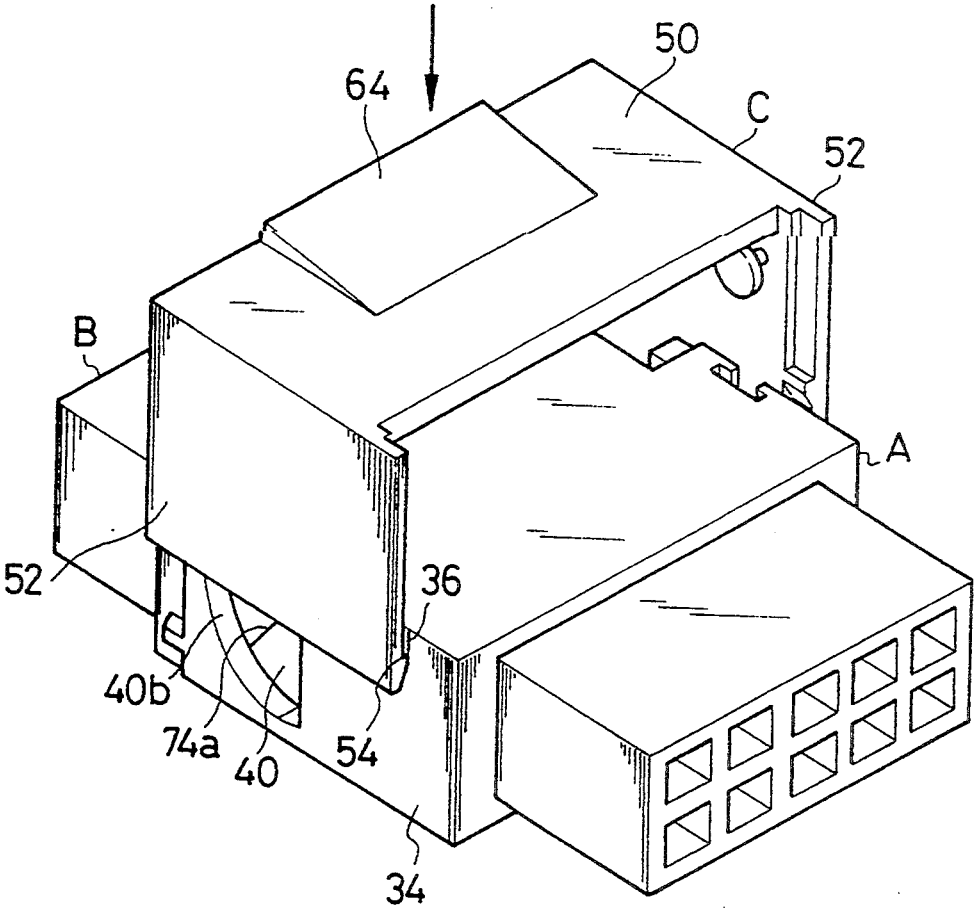
FIG. 6 is a perspective view in which the male connector is initially engaged in the female connector with the driving lever being temporarily coupled thereto.
Figure 7:
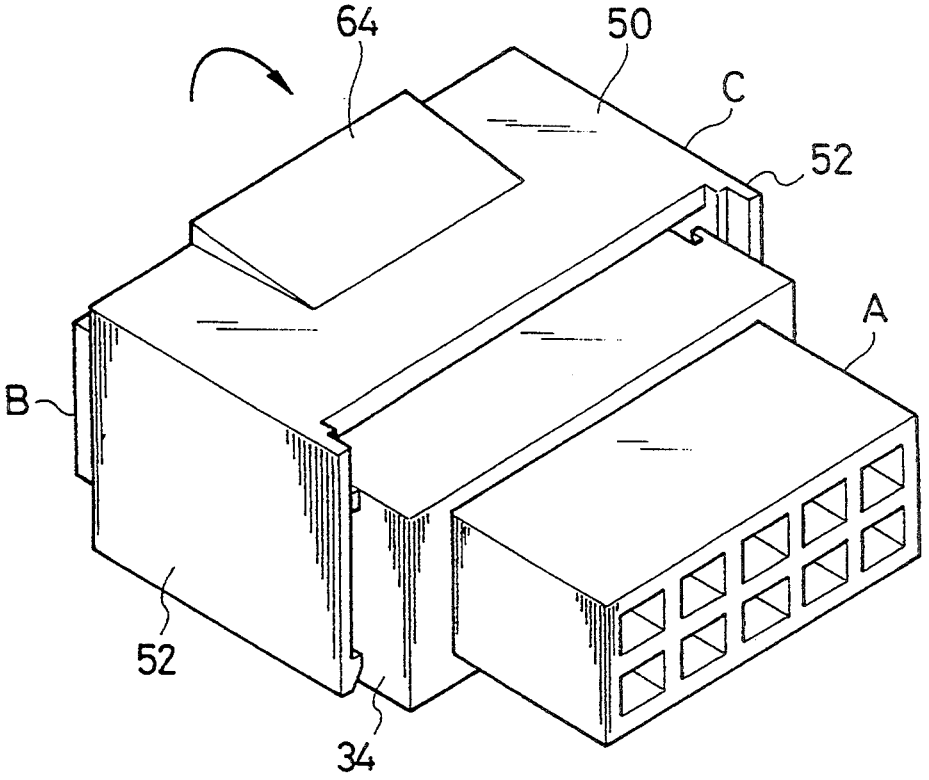
FIG. 7 is a perspective view in which the male connector is completely engaged in the female connector by pressing the driving lever downward.
Figure 8:
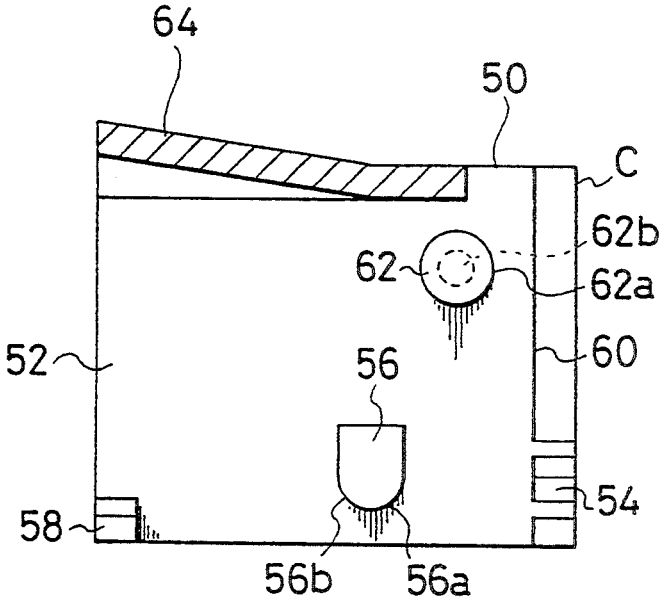
FIG. 8 is a cross-section of the driving lever.

As shown in FIG. 5, the female connector A comprises a box-like female connector main body 30. In the main body 30 a receiving recess 32 for receiving the male connector main body and both side walls 34 are provided. At upper rear end portions of these side walls 34 temporarily-stopping projections 36 are provided respectively. Further, support shaft engaging portions 38 are formed in the side walls 34 in front of these projections 36, respectively. These support shaft engaging portions 38 respectively receive rotary support shafts of the driving lever C so as to hold it rotatably. Each of these engaging portions 38 includes an engaging hole 38*a* opening upward and a notched portion 38*b* defining a groove extending downward.

In front of these engaging portions 38, notched portions 40 for operating a driving projection are provided respectively. As shown in the same drawing, each of these notched portions 40 defines a through hole extending from both the side wall 34 and top face 41 of the connector main body 30 to its interior. At the rear end of the opening of each notched portion 40 a vertical guide portion 40*a* is formed vertically to the coupling direction of these connectors. Further, an arcuate guide portion 40*b* is formed at the front end of the opening of the notched portion 40. In addition, temporarily-stopping auxiliary projections 42 are provided at each front edge of both the side walls 34. Furthermore, completely-stopping projections 44 are provided at the lower front ends of the side walls 34, respectively. Additionally, in the rear end of the female connector main body a plurality of holes 46 are formed for receiving connection terminals.

The driving lever C is mounted on the female connector A. The driving lever C has a top plate 50 and side plates 52 extending downward from both side edges of the top plate 50. At both lower rear ends of these side plates 52 temporarily-engaging recesses 54 are provided respectively. In addition, driving projections 56 are formed at lower central portions of side plates 52, respectively. Each of the driving projections 56 is inserted in the corresponding notched portion 40 of female connector A to drive the male connector B. The driving projection 56 comprises an arcuate bottom portion, a rear engaging edge 56*a* and a front engaging edge 56*b*. Further, at both lower front ends of side plates 52 completely-engaging portions 58 are provided corresponding to the aforementioned temproraliry-engaging auxiliary projections 42.

Vertical guide steps 60 extend vertically above both the temporarily-engaging recesses 54. These guide steps 60 are provided to guide vertically the driving lever C via both the temporarily-engaging projections 36 of female connector A. Furthermore, pivot support shafts 62 are provided above the temporarily-engaging recesses 54 and driving projections 56, respectively. Each of the support shafts 62 is engaged with the corresponding support shaft engaging portion 38 so as to pivot the driving lever C about these shafts 62. The support shaft 62 is composed of a circular plate portion 62*a* to be engaged with the corresponding engaging hole 38*a* and a shaft 62*b* to be engaged with the corresponding notched portion 38*b*. In addition, an operation portion 64 is provided at the front end of the top plate 50 to pivot the lever by operating it with a finger.

That is, the driving lever C is temporarily coupled to the female connector A by engaging the temporarily-engaging recesses 54 with the temporarily-engaging projections 36 of female connector A and making the bottom faces of completely-engaging portions 58 be in contact with the top faces of temporarily-engaging auxiliary projections 42 of female connector A, respectively. In that state, the driving lever C is held above the female connector A with its downward movement being hindered.

Returning to FIG. 4, the male connector B includes a box-like male connector main body 70 and a first top face 76. In the central portion of side walls 72 of the main body 70, driving notched portions 74 are formed respectively. These notched portions 74 are respectively engaged with the driving projections 56 of lever C to move the male connector B forward or backward. Each notched portion 74 has an engagement driving face 74*a* on its coupling side to the female connector. The slope defining the driving face 74*a* gradually descends toward the bottom face 78 to be used for driving the male connector A forward. Further, the driving notched portion 74 has a detachment driving face 74*b* on its detaching side to the female connector. Each detachment driving face 74*b* is substantially vertical to the coupling direction of these connectors to be used for moving the male connector A backward. In addition, holes 80 for receiving terminals are provided in the front face of male connector main body 70.

Next, the coupling operation in case of the easy-operation-type connector constructed as mentioned above will be described with reference to FIGS. 9 and 10.

Figure 9:
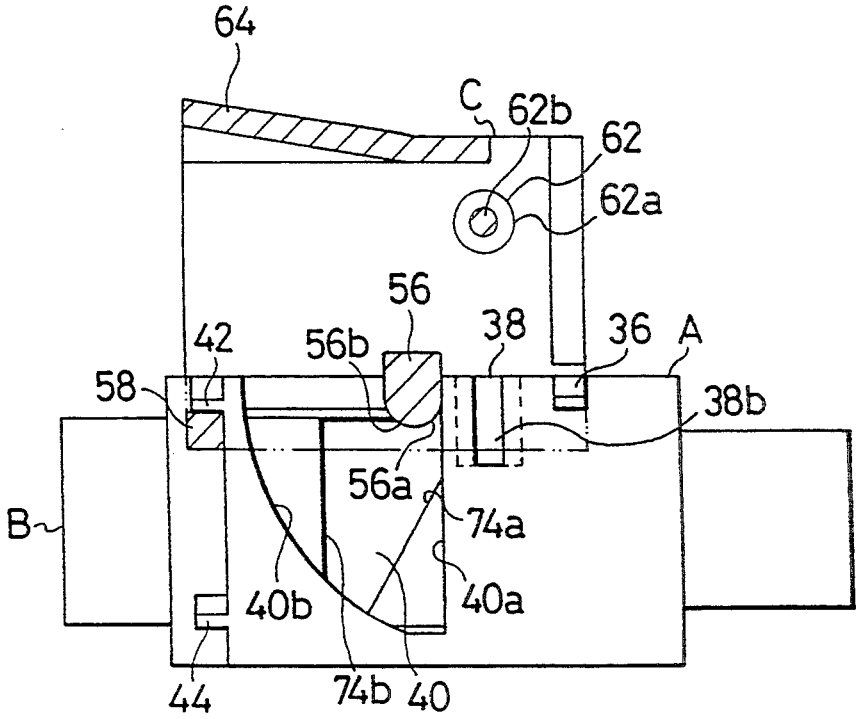
FIG. 9 is a partly broken perspective view of the initial engagement state of FIG. 6.
Figure 10:
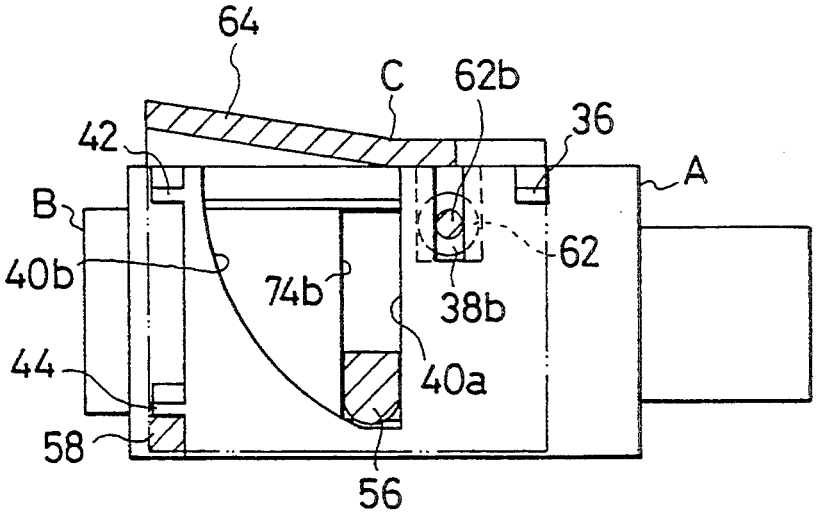
FIG. 10 is a partly broken perspective view of the complete engagement state of FIG. 7.

First, the female connector B is coupled to the male connector A so that tile distal ends of both terminals received in these connectors are in contact with one another. This state is shown in FIG. 9. Next, the lever C is pushed down from that state. Then, the rear engaging edge 56*a* of each driving projection 56 is in contact with the engagement driving face 74*a* of each driving notched portion 74. Thereafter, the edge 56*a* slides down on the engagement driving face 74*a* pressing it in the coupling direction. When the lever C is further pushed down so that its top plate 50 is in contact with the top face 41 of female connector A, the male connector B is completely coupled to the female connector A.

During the process, the rotary support shafts 62 are engaged in the support shaft engaging portions 38, that is, the circular plate portions 62*a* are engaged in the engaging holes 38*a* and the shafts 62*b* in the engaging notched portions 38*b*, respectively. In that final coupling state, the completely-engaging portions 58 are engaged with the corresponding completely-engaging projections 44 so as to hold the driving lever C on the connector main body.

Figure 11:
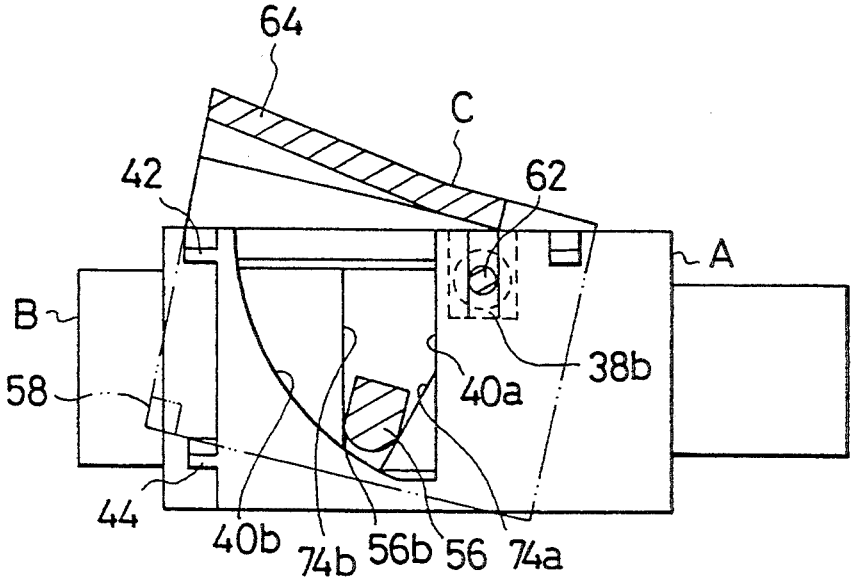
FIG. 11 is a partly broken perspective view in which the male connector is in the detaching mode.

Finally, the detaching operation between the male and female connectors will be described with reference to FIG. 11.

First, the driving lever C is raised by a finger via operation portion 64. Then, the lever C is pivoted about the rotary support shafts 62 respectively engaged with the support shaft engaging portions 38. In that state, the front engaging edge 56*b* of each driving projection 56 slides up on the detachment driving face 74*b* pushing the face in the detaching direction. Thus, the male connector B is detached from the female connector A. During this operation, each completely-engaging portion 58 is removed from the engagement with the corresponding completely-engaging projection 44 with the pivot movement of lever C.

As stated above, in the easy-operation-type connector of this invention, the driving projections of the driving lever are inserted in the driving recesses of the female connector through the corresponding openings so as to make each driving projection be in contact with each corresponding inclining face. When the driving lever is then pushed down, each driving projection slides down on the inclining face to move the male connector in the coupling direction. Thus, the male connector is coupled to the female connector. On the other hand, when the driving lever is pivoted in the state where the engaging projections of the driving lever are respectively engaged with the engaging recesses of the female connector, each of the driving projections slides up on the corresponding vertical face to move the male connector in the detaching direction.

Accordingly, both the coupling and detaching operations between the male and female connectors can be carried out only by the aforementioned pushing-down and pivot operations of the driving lever. Therefore, these coupling and detaching operations for the related connectors can be facilitated, and the construction of these connectors can be more compact.

Various modifications will become possible for those skilled in the art after receiving the teachings of the present disclosure without departing from the scope thereof.

What is claimed is:

1. An easy-operation-type connector, comprising:

a male connector; a female connector to be engaged with the male connector; and a driving lever for coupling and detaching the male and female connectors, wherein the male connector includes:

a male connector main body;

a first top face formed on the male connector main body;

a driven recess formed in the male connector main body and having an opening in the first top face;

an inclining face formed as an inner wall of the driven recess, the inclining face gradually descending along a removal direction of the male connector; and a vertical face formed as an inner wall of the driven recess, the vertical face facing in an engaging direction of the male connector;

the female connector including:

a female connector main body;

a second top face formed on the female connector main body;

a receiving recess formed in the female connector main body to receive the male connector;

an engaging recess formed in the female connector main body and having an opening in the second top face; and an aperture formed in the female connector main body and communicating from the second top face to the receiving recess; and the driving lever including:

a driving lever main body;

an engaging projection formed in the driving lever main body, the engaging projection being detachably engaged with the corresponding engaging recess; and a driving projection formed in the driving lever main body, the driving projection cooperating with the inclining face to move the male connector in an engaging direction when the driving lever is moved downwardly, while cooperating with the corresponding vertical face to move the male connector in a detaching direction when the driving lever pivots on the engaging projections as the engaging projection is engaged with the engaging recess.

2. The easy-operation-type connector according to claim 1, wherein:

the male connector main body is provided with a first side face and a second side face respectively extending downwardly from both side edges of the first top face; the driven recesses are formed in both the first side face of the male connector main body and the second side face of the male connector main body; the female connector main body is provided with a third side face and a fourth side face respectively extending downward from both side edges of the second top face; the engaging recesses are formed in both the third side face of the female connector main body and the fourth side face of the female connector main body; the apertures are formed in both the third side face of the female connector main body and the fourth side face of the female connector main body; the aperture formed in the third side face communicates from the third side face to the receiving recess, while the aperture formed in the fourth side face communicates from the fourth side face to the receiving recess; the driving lever main body is provided with a top plate, a first side plate and a second side plate, the first side plate and the second side plate respectively extending downwardly from both side edges of the top plate; the engaging projections are provided on both an inside face of the first side plate and an inside face of the second side plate; and the driving projections are also provided with both the inside face of the first side plate and the inside face of the second side plate.

3. The easy-operation-type connector according to claim 2, wherein:

the engaging projection includes a shaft projecting inwardly from the side plate and a circular plate portion provided at the distal end of the shaft, the circular plate having a diameter larger than that of the shaft, and the engaging recess being formed in a dovetail groove shape for receiving the circular plate portion through the opening in the second top face.

4. The easy-operation-type connector according to claim 2, wherein:

the driving projection has an arcuate bottom portion projecting downwardly.

5. The easy-operation-type connector according to claim 2, further comprising: an operation portion provided at the driving lever main body for pivoting the driving lever by a finger.

* * * * *